US008755186B2

(12) United States Patent
Kitajima et al.

(10) Patent No.: US 8,755,186 B2
(45) Date of Patent: Jun. 17, 2014

(54) HEAT PIPE TYPE COOLING DEVICE AND RAILCAR CONTROL EQUIPMENT USING THE SAME

(75) Inventors: Hironori Kitajima, Tsuchiura (JP); Hitoshi Sakayori, Tsukuba (JP); Yuuzou Shiraishi, Tsuchirua (JP)

(73) Assignee: Hitachi Power Solutions Co., Ltd., Ibaraki (JP)

( * ) Notice: Subject to any disclaimer, the term of this patent is extended or adjusted under 35 U.S.C. 154(b) by 467 days.

(21) Appl. No.: 13/114,308

(22) Filed: May 24, 2011

(65) Prior Publication Data

US 2012/0002373 A1 Jan. 5, 2012

(30) Foreign Application Priority Data

Jul. 2, 2010 (JP) ..... 2010-152005

(51) Int. Cl.
*H05K 7/20* (2006.01)
*F28F 7/00* (2006.01)
*H01L 23/34* (2006.01)

(52) U.S. Cl.
USPC ..... 361/700; 165/80.4; 165/104.33; 165/104.14; 257/715; 257/E23.088

(58) Field of Classification Search
USPC ..... 361/679.52, 679.47, 700; 165/80.4–80.5, 104.33, 104.14; 174/15.2; 257/715, E23.088
See application file for complete search history.

(56) References Cited

U.S. PATENT DOCUMENTS

| | | | | |
|---|---|---|---|---|
| 5,720,339 | A * | 2/1998 | Glass et al. | 165/104.26 |
| 5,924,479 | A * | 7/1999 | Egbert | 165/104.14 |
| 6,515,446 | B1 * | 2/2003 | Koide et al. | 318/700 |
| 7,545,630 | B2 * | 6/2009 | Artman et al. | 361/679.47 |
| 7,967,473 | B2 * | 6/2011 | Huang et al. | 362/294 |
| 2005/0247437 | A1 * | 11/2005 | Ying et al. | 165/104.33 |
| 2009/0050305 | A1 | 2/2009 | He et al. | |
| 2010/0181047 | A1 * | 7/2010 | Lin et al. | 165/104.26 |

FOREIGN PATENT DOCUMENTS

| | | |
|---|---|---|
| JP | 2-229455 | 9/1990 |
| JP | 7-190655 | 7/1995 |
| JP | 9-119785 | 5/1997 |
| JP | 10038482 | 2/1998 |
| JP | 3020790 | 1/2000 |
| JP | 3700870 | 7/2005 |

* cited by examiner

*Primary Examiner* — Zachary M Pape
(74) *Attorney, Agent, or Firm* — Brundidge & Stanger, P.C.

(57) ABSTRACT

An economical heat pipe type cooling device with high performance and stable start at low environmental temperatures below 0° C., and a railcar control equipment using the invented heat pipe type cooling device are provided. The midsection between two bents formed on a heat pipe is used as an evaporator; lengths of two distal sections to be used as the condenser sections are intentionally differentiated each from the other; and the condenser section of greater length is provided with heat radiating fins more than those on the condenser section of shorter length. This configuration permits each of two condenser sections to be provided with mutually different condensing capacity and accordingly the condenser section of shorter length works to cool heat-generating elements even though the condenser section of greater length would suffer from freezing problem at low temperatures. A sufficient cooling effect is rendered at ordinary temperature.

9 Claims, 6 Drawing Sheets

(PLAN VIEW)

(FRONT VIEW)

(SIDE VIEW)

(PLAN VIEW)

HEAT PIPE TYPE COOLING DEVICE AND RAILCAR CONTROL EQUIPMENT USING THE SAME

TECHNICAL FIELD

The present invention relates to a heat pipe type cooling device used for cooling semiconductor elements or similar devices and a railcar control equipment using the same.

BACKGROUND OF THE INVENTION

In a conventional art, cooling a heat-generating element like a semiconductor device has been performed in such a manner that such heating element is mounted on a heat absorption block having good heat conduction and a plurality of heat pipe type cooling systems are installed thereon for cooling thereof and consequently the heat-generating element. The condenser section of the heat pipe is often used with multiple heat radiating fins attached thereon to accelerate condensation.

JP 3700870 B2 has described a heat pipe type cooler. The cooler described therein has a loop-shaped heat pipe, or an approximately U-shaped heat pipe, installed on a heat absorption block, wherein the lengths of the opposing two condenser sections of the U-shape are equal each to the other. The cooler offers good heat exchange efficiency since a part of the heat pipe is formed in a style of a horizontal heater. However, there is a problem in this art. When water for example is used as the working fluid of the heat pipe, the water inside the heat pipe freezes where the ambient temperature is below 0° C. Under this condition consequently, two opposing condenser sections of equal length on the heat pipe do not fully function causing the temperature of the semiconductor device to become possibly in excess of the specified permissible operating temperature.

JP 02-229455 A has described an apparatus of heat pipe system having a plurality of rod-shaped heat pipes filled with different types of working fluid. The heat pipes are divided into groups of two or more and each of the heat pipes in a group is filled with different working fluid particular to the group. For example, where the heat pipes in one group are filled with Furon R-113 as the working fluid and the heat pipes in other group with water, the system works well even at low temperatures because Furon R-113 does not freeze at the ambient temperature of 0° C. or lower. Further, this arrangement enables the heat pipe system to offer a high performance at usual operating temperatures.

JP 3020790 B2 has described a heat pipe type cooling device having a plurality of rod-shaped heat pipes. The heat pipes are divided into groups of two or more and each of the heat pipes in a group is given different pipe lengths, or is attached with differently arranged heat radiating fins particular to the group. The long heat pipes are attached with heat radiating fins in a number larger than that of the short heat pipes; therefore, they have a greater cooling capacity. Even at low temperatures, the short heat pipe still works as a heat pipe enabling a heat-generating element to be cooled, although the working fluid in the long heat pipe freezes at such temperatures.

SUMMARY OF THE INVENTION

As stated above, the use of the U-shaped heat pipe as defined in JP 3700870 B2 involves such a problem that the heat pipe in the cooler would not work well where the ambient temperature is below 0° C. The use of plural heat pipes of rod-shaped as defined in JP 02-229455 A or JP 3020790 B2 involves such a problem that the products would become expensive, because the heat pipes must be used in an increased number as the plurality of the heat pipes are comprised of independent heat pipes.

Where the U-shaped heat pipe described in JP 3700870 B2 is applied to the apparatus of heat pipe system defined in JP 02-229455 A, it is necessary to provide several types of heat pipes severally using different kinds of coolant as the working fluid. In this application, each of the heat pipes still does not fully work as an independent heat pipe; thus the application will encounter such a problem that the structure of the apparatus becomes complicated and expensive in const.

Where the U-shaped heat pipe described in JP 3700870 B2 is applied to the cooling device defined in JP 3020790 B2, the application will encounter such a problem that the overall performance of the cooling device will become poor. Although the use of U-shaped heat pipes of several different lengths provides them with condensation properties in variety and the U-shaped heat pipe of shorter length will improve the device performance as it enables the device to start at lower temperatures, the arrangement of the U-shaped heat pipe of shorter length and the U-shaped heat pipe of greater length becomes one-sided. Therefore, each of the heat pipes still does not fully work as an independent heat pipe and heat radiating fins are not efficiently used with poor overall performance.

From the viewpoint of these problems, the present invention aims at providing such an economical heat pipe type cooling device that each of the heat pipes works as an independent heat pipe rendering efficient heat exchange with a heat-generating element with high performance and stable start at low temperatures.

Means for Solving the Problems

To solve above-stated problems, the present invention provides a heat pipe type cooling device comprising a heat absorption block, in which part of a heat pipe is embedded as the evaporator section (sometimes called a heat-in section) of the heat pipe and on which a heat-generating element is mounted as an object to be cooled, and a plurality of heat radiating fins that are installed on the other part of the heat pipe as the condenser section of the heat pipe, wherein the heat pipe, which is a J-shaped heat pipe having two bents thereon, is comprised of a heat-in section, which is located at the midsection of the heat pipe, working as the evaporator section of the heat pipe; a first heat-out section, which is located on a portion of the heat pipe other than the evaporator section, working as the condenser section of the heat pipe having a plurality of heat radiating fins thereon; and a second heat-out section, which is located on a portion of the heat pipe other than the evaporator section and the first heat-out section, working as another condenser section of the heat pipe having a larger number of heat radiating fins thereon than that of on the first heat-out section, wherein the length of the second heat-out section is greater than that of the first heat-out section.

The present invention further provides the heat pipe type cooling device as defined above, wherein the heat-in section working as the evaporator section is comprised of a straight-shaped portion.

The present invention still provides the heat pipe type cooling device as defined above, wherein the first heat-out section and the second heat-out section are comprised of straight-shaped portions.

The present invention still further provides the heat pipe type cooling device as defined above, wherein the heat-in section working as the evaporator section of the heat pipe is divided into two sections at a predetermined point thereof by means of pressing or crimping.

The present invention more provides the heat pipe type cooling device having a plurality of heat pipes as defined above, wherein the first heat-out section and the second heat-out section working as the condenser sections of the heat pipe are embedded in the heat absorption block with an alternating positioning.

The present invention further more provides a railcar control equipment for controlling an electric motor that drives a railcar, wherein the railcar controlling equipment uses above-stated heat pipe type cooling device as the cooling device for cooling a semiconductor device that is the primary circuitry in the railcar control equipment.

The heat pipe type cooling device by the present invention is capable of cooling semiconductor devices or similar elements efficiently. That is, the invented system exhibits high cooling performance under ordinary temperatures and further exhibits its performance as desired even in an environment where the atmosphere temperature is lower than the freezing point of the working fluid. This is because the second heat-out section is given a length greater than that of the first heat-out section and has a larger number of heat radiating fins thereon than that on the first heat-out section. Further, it becomes practicable to use the heat pipe type cooling device by the present invention as an effective cooling device for railcar control equipment.

DETAILED DESCRIPTION OF THE PREFERRED EMBODIMENTS

The following provides an explanation of the embodiments of the present invention referring to drawings.

Example 1

Figure 1:
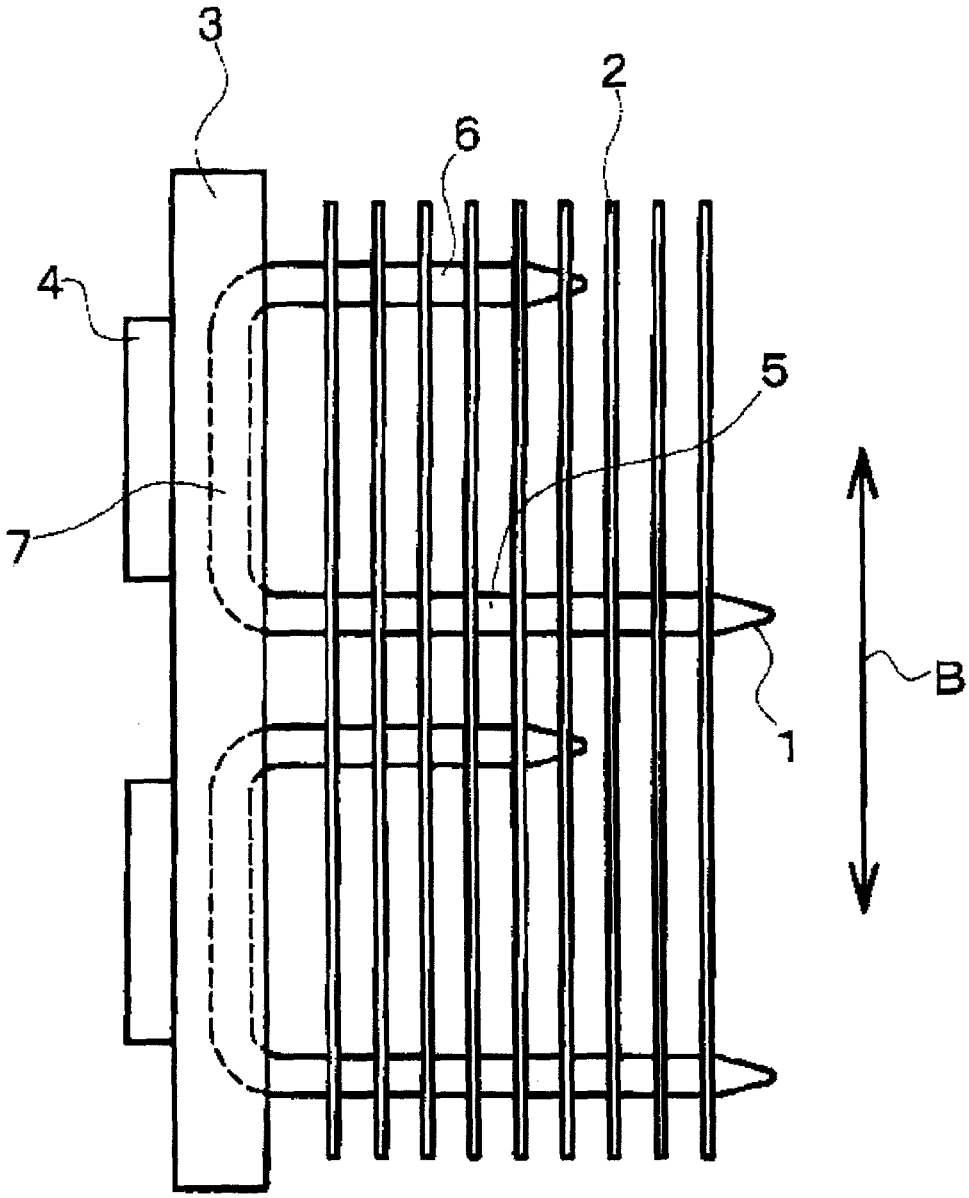
FIG. 1 is a plan view of the heat pipe type cooling device as the first embodiment of the present invention.
Figure 2:
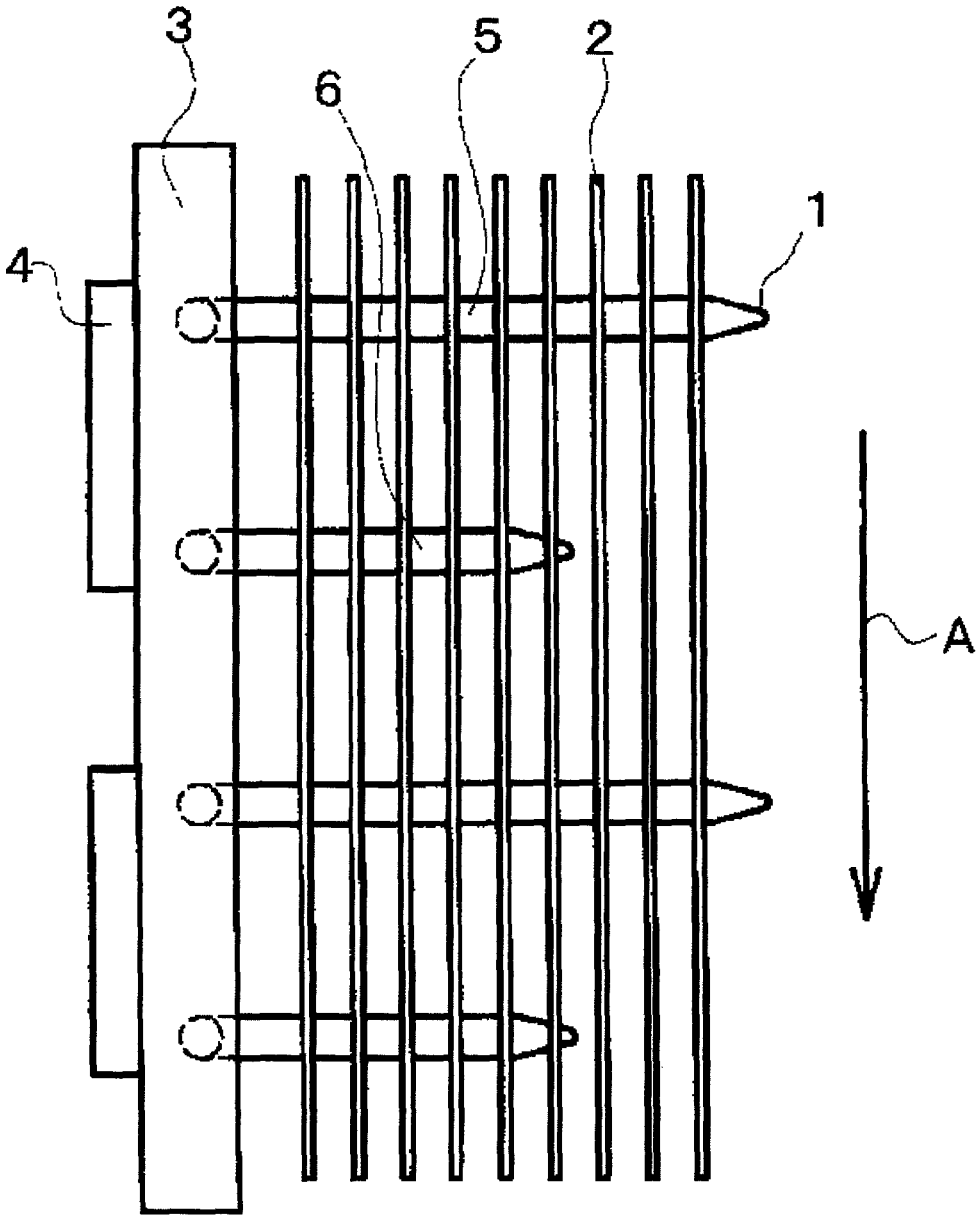
FIG. 2 is a front view of the heat pipe type cooling device as the first embodiment of the present invention.
Figure 3:
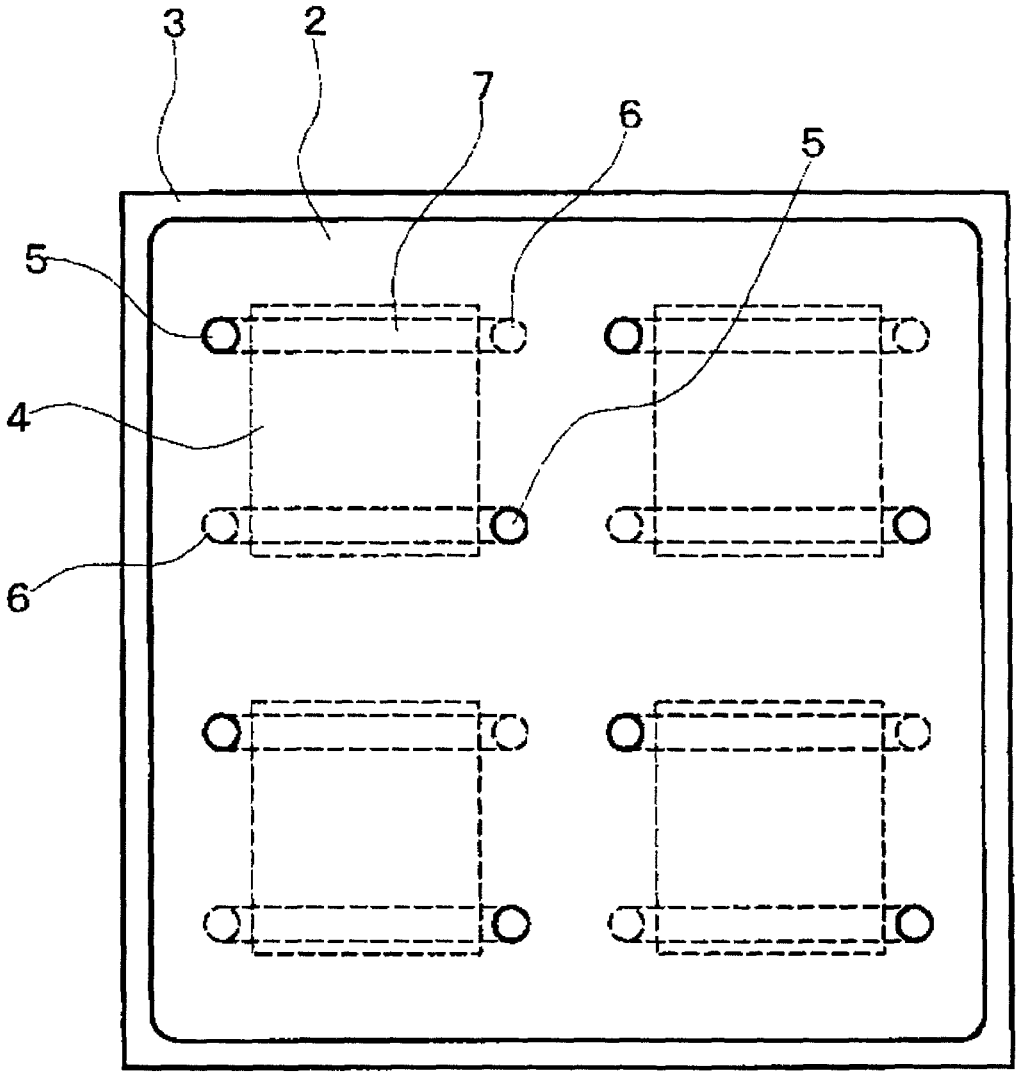
FIG. 3 is a side view of the heat pipe type cooling device as the first embodiment of the present invention.

FIGS. 1 to 3 illustrate the first embodiment of the present invention. The heat pipe type cooling device of this embodiment is comprised mainly of a plurality of heat pipes 1 installed on a heat absorption block 3, a plurality of heat radiating fins 2 installed on the heat pipe 1 in the longitudinal direction thereof, and a heat-generating element 4 such as a semiconductor device mounted on the heat absorption block 3. FIG. 1 and FIG. 2 illustrate only such a heat pipe as can be seen from the near side.

The materials used are copper for the casing of the heat pipe 1 and water for the working fluid. The material of the heat absorption block 3 is such material as has good heat conductivity like copper and aluminum. Joining the heat absorption block 3 with the heat pipe 1 can be established by soldering, crimping, or heat expansion joining method that expands the heat pipe applying heat. Joining the heat pipe 1 with the heat radiating fin 2 can be established also by soldering, crimping, or heat expansion joining method.

The heat pipe 1 is a J-shaped heat pipe having two bents thereon. A straight portion at the midsection of the heat pipe forms a straight midsection 7 (hereinafter referred to as a heat-in section 7), which is embedded in the heat absorption block 3 to work as an evaporator. A first heat-out section 6, which is a straight portion of the heat pipe adjacent to the end of the heat-in section 7 working as the evaporator, has a plurality of heat radiating fins and works as a condenser. A second heat-out section 5, which is another straight portion of the heat pipe adjacent to the other end of the heat-in section 7, works also as a condenser.

The lengths of the first heat-out section 6 and the second heat-out section 5 are intentionally differentiated each from the other. The heat radiating fins 2, which are evenly shaped flat plates, are arranged in parallel to the heat absorption block 3 with a regular uniform spacing between fins. Because the length of the first heat-out section 6 is different from that of the second heat-out section 5, each of which section is working as the condenser, the second heat-out section 5 is provided with heat radiating fins thereon more than that of on the first heat-out section 6 in number; consequently this feature enlarges the heat radiating area of the second heat-out section 5. With this construction, it becomes practicable to differentiate the condensing capacity of the second heat-out section 5, a long section, from that of the first heat-out section 6, a short section.

It is preferable in an actual implementation that, where the length of the second heat-out section 5 is 300 mm to 400 mm, the length of the first heat-out section 6 should be ½ to ⅔ of such length; and in most cases, the heat radiating fins are installed at a spacing 3 mm to 7 mm. FIG. 1 illustrates an example wherein the length ratio between them is 3 to 2. The numbers of the heat radiating fins to be installed on the second heat-out section 5 and on the first heat-out section 6 are determined corresponding to this length ratio and the fin spacing stated above. In the example illustrated in FIG. 1, the second heat-out section 5 has nine fins and the first heat-out section 6 has six fins because the length ratio is 3 to 2.

The following explains the behavior and working of the heat pipe type cooling device in the embodiment thus configured. When the heat pipe type cooling device in the embodiment is put in use at temperatures below 0° C., the freezing point of the working fluid of water, the working fluid staying inside the heat-in section 7 working as the evaporator, is frozen at the time starting the cooling device. When heat of the heat-generating device 4 such as semiconductor element transfers to the heat-in section 7 working as the evaporator through the heat absorption block 3 on starting the device, temperature of the heat-in section 7 rises causing the working fluid to melt turning into vapor, which begins conveying heat to the condenser section.

The second heat-out section 5 of greater length has the heat radiating fins more than those provided on the first heat-out section 6 of shorter length in number. Therefore, the condensing capacity of the second heat-out section 5 is large; this may invite a problem in that the working fluid of water may freeze again in the second heat-out section 5. In this event, the second heat-out section 5 does not work as a heat pipe, that is, no heat is conveyed. In contrast, the first heat-out section 6 of shorter length has the heat radiating fins less than those provided on the second heat-out section 5 in number. Therefore, the condensing capacity of the first heat-out section 6 is smaller than that of the second heat-out section. This allows the working fluid to function as the heat pipe mechanism requires, because the working fluid flows back to the evaporator without freezing at the condenser section.

Under this situation, functioning evaporator in the heat pipe is only the first heat-out section 6 and accordingly the overall heat radiation performance of the cooling device will be lowered. However, this does not bring any practical problems, because the atmosphere temperature is below the freezing point of the working fluid of water and therefore there is a sufficient temperature difference between the atmosphere temperature and the operating temperature of the heat-generating device 4. The quantity of the working fluid to fill the heat pipe should preferably be such amount that the first heat-out section 6 of shorter length can maintain being supplied with vapor of the working fluid even when the working fluid in the second heat-out section 5 of greater length freezes.

As mentioned, the first heat-out section 6 is effective in prevention of freezing. Therefore, use of water as the working fluid without relying on alternative halocarbon becomes practicable with reduced environmental load.

When the cooling device of the embodiment is operated at an ordinary temperature (a temperature higher than the freezing point of the working fluid), all the condenser sections (the first heat-out section 6 and the second heat-out section 5) function as heat pipes delivering high cooling performance. In the embodiment as stated above, the heat-in section 7 at the midsection, the first heat-out section 6, and the second heat-out section 5 form one independent heat pipe on one heat absorption block 3. Thus, a heat pipe type cooling device having high performance that exhibits cooling properties as intended even at low temperatures is obtained.

In the embodiment, the direction of force of gravity is indicated in FIG. 2 with an arrow A of the front view. In FIG. 2, the heat pipe 1 is arranged in parallel with ground (horizontal). However, the heat pipe 1 may be installed with a slant of about 5 to 10 degrees with the distal end up to accelerate flow-back of the working fluid condensed inside the heat pipe 1.

Figure 4:
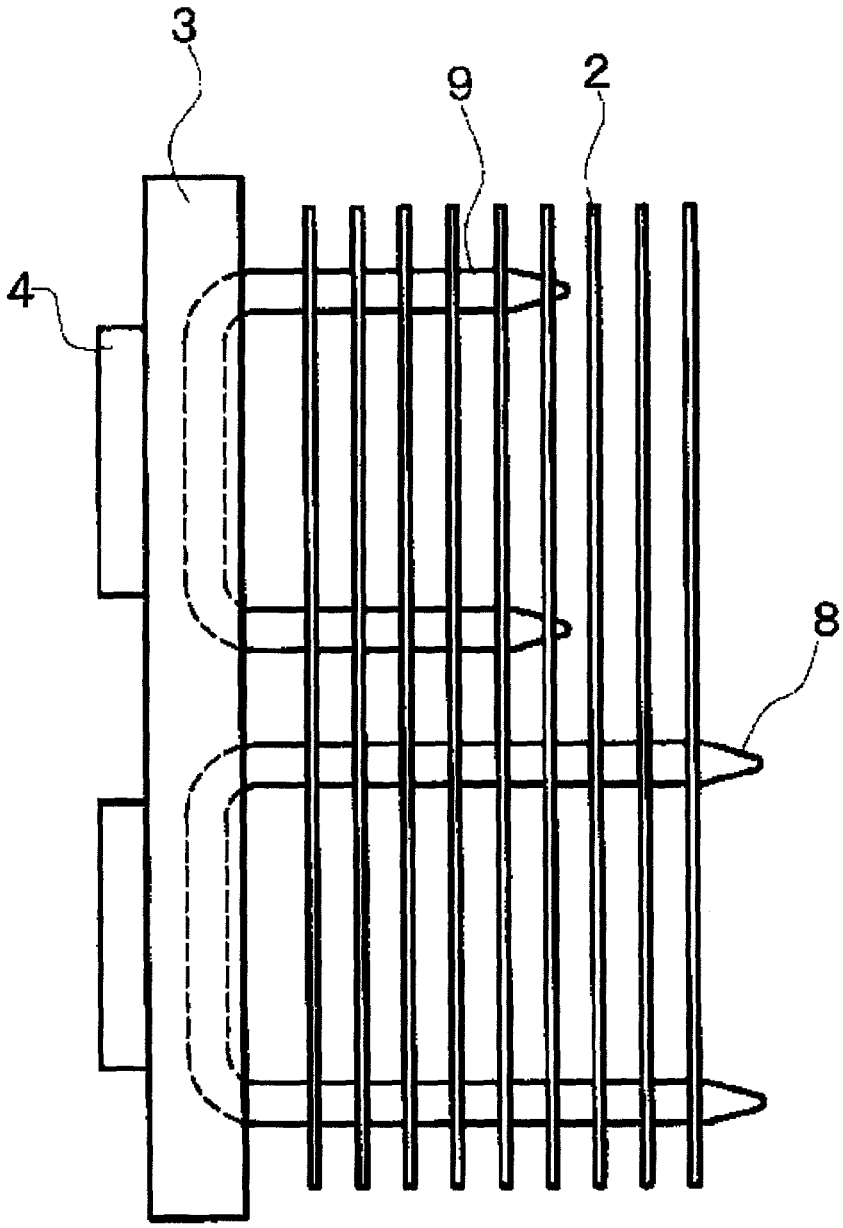
FIG. 4 illustrates a comparison example with the embodiment illustrated in FIG. 1.

FIG. 4 illustrates a comparison example with the heat pipe type cooling device of the first embodiment. A heat pipe type cooling system being compared is equipped with J-shaped heat pipes of two styles, a heat pipe 8 and a heat pipe 9, wherein each of them has the first heat-out section and the second heat-out section of the same length. The heat pipe 8, as the one style of the J-shaped heat pipe, has a long condenser section; and the heat pipe 9, as the other style of the J-shaped heat pipe, has a short condenser section. Thereby, the cooling system gives each heat pipe different condensing capacities to obtain desired performance at temperatures below the freezing point of water; this technique is the same as the art in the first embodiment.

This configuration lowers the overall performance of the cooling system because the efficient use of heat radiating fins is prevented by a one-sided arrangement of the heat pipe 8 of greater length and the heat pipe 9 of shorter length in the cooling system. In contrast, the heat pipe type cooling device of the first embodiment illustrated in FIGS. 1 to 3 offers high performance because the heat radiating fins 2 are efficiently used. This is because each of the heat pipes is independent each from the other and thereby an even arrangement of the heat pipes of greater length (the second heat-out section 5) and the heat pipe of shorter length (the first heat-out section 6) is made practicable.

Example 2

Figure 5:
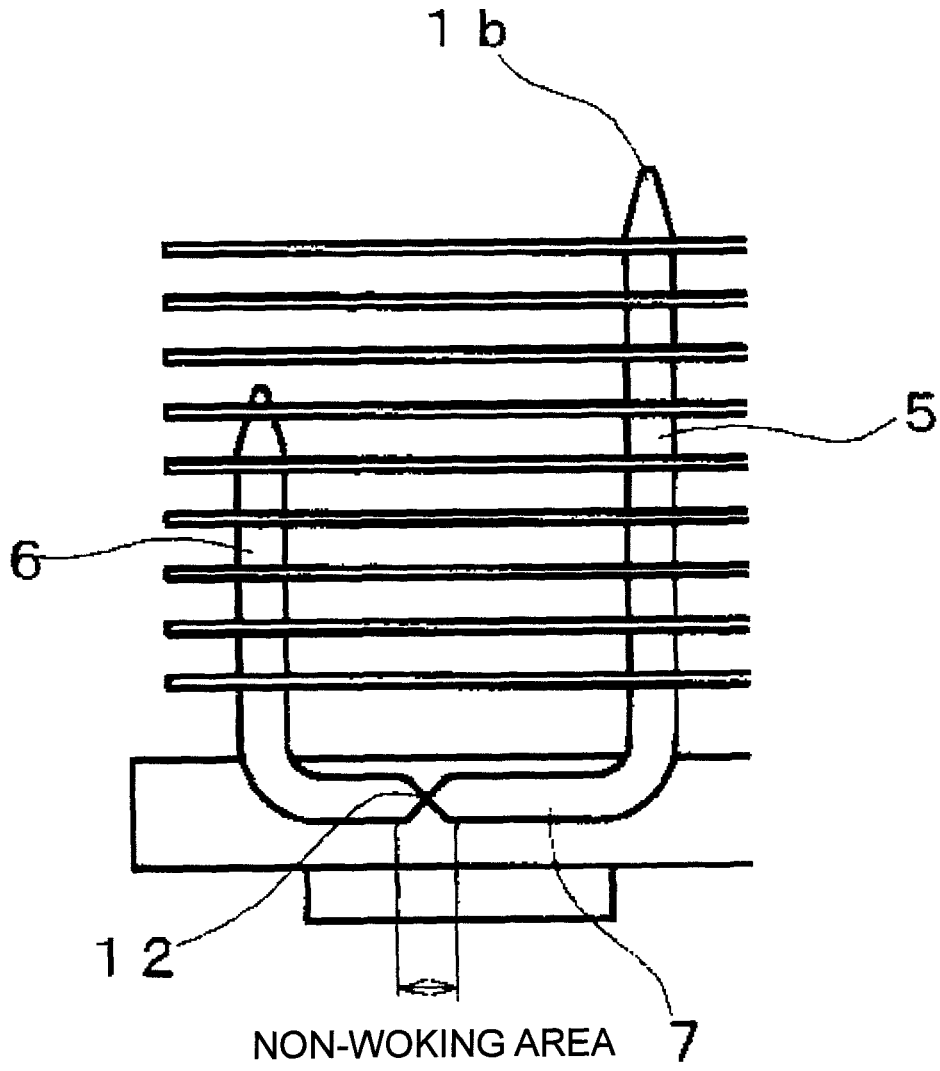
FIG. 5 is a plan view of the heat pipe type cooling device as the second embodiment of the present invention.

FIG. 5 illustrates the second embodiment of the present invention. The overall structure, principle of working, and method of use of this heat pipe type cooling device are the same as the first embodiment illustrated in FIGS. 1 to 3. Constituents same as those in the first embodiment are denoted by the same numeral signs. FIG. 5 illustrates one heat pipe for simplicity. A heat pipe 1*b* is given two bents to purposely give differentiated lengths on the condenser sections so that different condensing capacity will be severally provided; this feature is the same as the one in the first embodiment. In constructing this configuration, a pressed or crimped portion is formed at the predetermined point in the heat-in section 7 (the evaporator section) of the straight midsection of the heat pipe 1*b* to provide a separation on the casing of the heat pipe by pressing or crimping applied to that position. Because a pressed or crimped portion 12 can be formed within a minimum-required length, the longitudinal occupation of the non-working area is minimized.

This configuration makes the heat pipe lb behave as if two L-shaped heat pipes of different lengths are equipped although the installed heat pipe is one. Thus, it becomes practicable to determine the quantity of the working fluid for each of the heat-out sections 5 and 6 without, unlike in the first embodiment, consideration of the freezing amount of the working fluid in the condenser section 6 of greater length, with increased degree of freedom. In constructing this configuration, the ratio between the lengths of the heat-out sections 5 and 6 separated at the heat-in section 7 can be determined simply according to the above-stated difference of the condensing capacity.

This means that it is enough to determine each length of the second heat-out section 5 (the condenser section of greater length) according only to the ratio of the condensing capacities of the second heat-out section 5 (the condenser section of greater length) and the first heat-out section 6 (the condenser section of shorter length).

It is preferable in an actual implementation that, where the length of the second heat-out section 5 is 300 mm to 400 mm, the length of the first heat-out section 6 should be ½ to ⅔ of such length; and in most cases, the heat radiating fins are installed at a spacing 3 mm to 7 mm.

Figure 6:
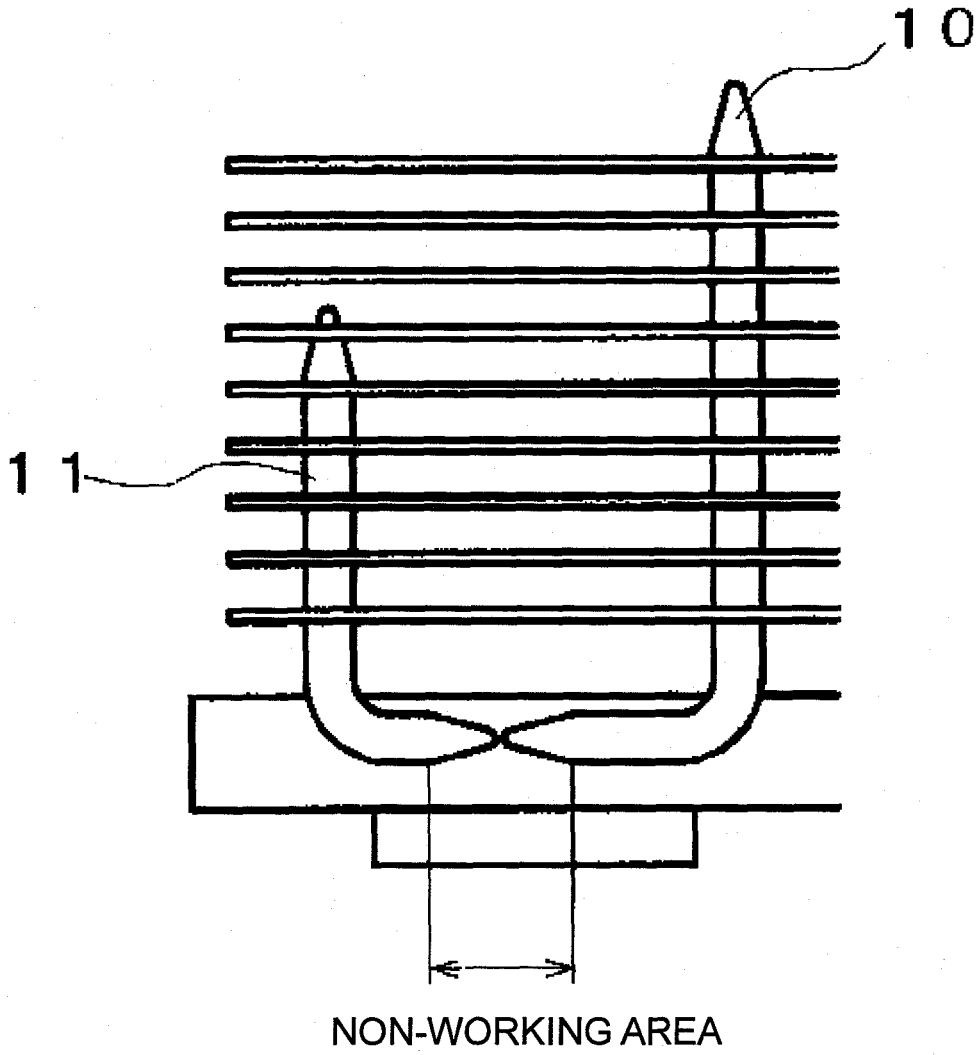
FIG. 6 illustrates a comparison example with the embodiment illustrated in FIG. 5.

FIG. 6 illustrates a comparison example with the second embodiment. In the embodiment, a long-L-shaped heat pipe 10 and a short-L-shaped heat pipe 11 are installed to obtain an equivalent effect that the heat pipe illustrated in FIG. 5 offers. This arrangement provides a similar heat pipe system configuration, but the heat pipes must be prepared two times in number with increased cost. At the ends of the heat pipes, casing end seals are provided by swaging or welding, which produce non-working areas on the heat pipes. Arranging the heat pipes 10 and 11 as illustrated in FIG. 6 makes the non-working areas of them, which are in contact with the heat absorption block 3, to be adjoined each other with reduced effective length and poor space factor. This decreases the heat-transfer efficiency resulting in a lowered overall performance of the cooling system.

Where the first embodiment and the second embodiment are employed for cooling the primary circuitry in railcar control equipment, mounting the cooling device in such an orientation that the running direction of the railcar in terms of the cooling device is as indicated by arrow B in FIG. 1 permits using traveling wind as the cooling airflow; thereby the heat radiation efficiency increases more compared to such a configuration that the heat radiating fins 2 are placed across the direction of railcar running. This is because the heat radiating fins 2 are well ventilated since they are arrayed along the running direction of the railcar. As long as the heat radiating fins 2 are arrayed along the running direction of the railcar, the cooling device may be installed in any posture. For example, the heat pipe may be mounted upright with respect to the direction of force of gravity so that the tip of the heat pipe will be directed upward. Further, when the heat absorption block 3 is designed to be used commonly to the housing of the railcar control equipment, the space factor will be improved contributing downsizing the equipment.

The present invention is applicable not only to the above-stated railcar control equipment but also widely to many usages for cooling systems for semiconductor devices in a cold climate for example: a general-purpose inverter for controlling an alternating-current motor and an optical transmission device for communications.

In the embodiments stated above, copper is used as the material of casings of heat pipes and water is used as the working fluid. However, the present invention does not give any material limitation; any material may be used for the casing of the heat pipe and as the working fluid. Further, material for the heat absorption block and the heat radiating fin is not limited to above stated substance; any material can be used.

The invention claimed is:

1. A heat pipe type cooling device comprising:

a heat absorption block, in which part of a heat pipe is embedded as an evaporator section of said heat pipe and on which a heat-generating element is mounted as an object to be cooled, and a plurality of heat radiating fins that are installed on another part of said heat pipe as a condenser section of said heat pipe, wherein said heat pipe, which is a J-shaped heat pipe having two bents thereon, is comprised of:

a heat-in section, which is located at the midsection of said heat pipe, working as said evaporator section of said heat pipe;

a first heat-out section, which is located on a portion of said heat pipe other than said evaporator section, working as a condenser section of said heat pipe having a plurality of heat radiating fins thereon; and a second heat-out section, which is located on a portion of said heat pipe other than said evaporator section and said first heat-out section, working as another condenser section of said heat pipe having a larger number of heat radiating fins thereon than that of said first heat-out section, wherein the length of said second heat-out section is greater than that of said first heat-out section so that said second heat-out section has a condensing capacity larger than that of said first heat-out section, wherein said heat-in section is comprised of a straight-shaped pipe portion, and wherein said straight-shaped pipe portion is comprised of a pressed or crimped portion, a first straight-shaped pipe portion extending between said pressed or crimped portion and said first heat-out section, and a second straight-shaped pipe portion extending between said pressed or crimped portion and said second heat-out section, said second straight-shaped pipe portion having a length greater than that of said first straight-shaped pipe portion.

2. The heat pipe type cooling device according to claim 1 further comprising:

more than one of said heat pipe, said more than one of said heat pipe comprising a plurality of heat pipes, wherein said heat-in sections of said plurality of heat pipes are embedded in said heat absorption block so that said first heat-out sections and said second heat-out sections of said heat pipes are positioned alternately.

3. A railcar control equipment for controlling an electric motor that drives railcars, wherein said railcar control equipment uses the heat pipe type cooling device according to claim 2, as a cooling device for cooling the heat-generating element which is a semiconductor device that is the primary circuitry in said railcar control equipment.

4. The heat pipe type cooling device according to claim 3, wherein said heat radiating fins are each arrayed along a running direction of said railcar.

5. A railcar control equipment for controlling an electric motor that drives railcars, wherein said railcar control equipment uses the heat pipe type cooling device according to claim 1, as cooling device for cooling the heat-generating element which is a semiconductor device that is the primary circuitry in said railcar control equipment.

6. The heat pipe cooling device according to claim 5, wherein said heat radiating fins are each arrayed along a running direction of said railcar.

7. A railcar control equipment for controlling an electric motor that drives railcars, wherein said railcar control equipment uses the heat pipe type cooling device according to claim 6, as a cooling device for cooling the heat-generating element which is a semiconductor device that is the primary circuitry in said control equipment.

8. A heat pipe type cooling device comprising:

a heat absorption block, in which part of a heat pipe is embedded as an evaporator section of said heat pipe and on which a heat-generating element is mounted as an object to be cooled, and a plurality of heat radiating fins that are installed on another part of said heat pipe as a condenser section of said heat pipe, wherein said heat pipe, which is a J-shaped heat pipe having two bents thereon, is comprised of:

a heat-in section, which is located at the midsection of said heat pipe, working as said evaporator section of said heat pipe;

a first heat-out section, which is located on a portion of said heat pipe other than said evaporation section, working as a condenser section of said heat pipe having a plurality of heat radiating fins thereon; and a second heat-out section, which is located on a portion of said heat pipe other than said evaporation section and said first heat-out section, working as another condenser of said heat pipe having a larger number of heat radiating fins thereon then that of said first heat-out section, wherein the length of said second heat-out section is greater than that of the first heat-out section so that said second heat-out section has a condensing capacity larger than that of said first heat-out section, wherein said heat-in section is comprised of a straight-shaped pipe portion, and wherein said straight-shaped pipe portion is comprised of a pressed or crimped portion and first and second straight-shaped pipe portions into which said straight-shaped pipe portion is divided at said pressed or crimped portion by means of pressing or crimping, said first straight-shaped pipe portion extending between said pressed or crimped portion and said first heat-out section, said second straight-shaped pipe portion extending between said pressed or crimped portion and said second heat-out section, and said second straight-shaped pipe portion having a length greater than that of said first straight-shaped pipe portion.

9. The heat pipe type cooling device according to claim 8, further comprising:

more than one of said heat pipe, said more than one of said heat pipe comprising a plurality of heat pipes, wherein said heat-in sections of said plurality of heat pipes are embedded in said heat absorption block so that said first heat-out sections and said second heat-out sections of said heat pipes are positioned alternately.

* * * * *